US007681974B2

(12) United States Patent
Mizuno

(10) Patent No.: US 7,681,974 B2
(45) Date of Patent: Mar. 23, 2010

(54) RECORDING APPARATUS AND METHOD

(75) Inventor: Hidekazu Mizuno, Nagano-Ken (JP)

(73) Assignee: Seiko Epson Corporation, Tokyo (JP)

( * ) Notice: Subject to any disclaimer, the term of this patent is extended or adjusted under 35 U.S.C. 154(b) by 393 days.

(21) Appl. No.: 11/724,785

(22) Filed: Mar. 15, 2007

(65) Prior Publication Data

US 2007/0216718 A1 Sep. 20, 2007

(30) Foreign Application Priority Data

Mar. 15, 2006 (JP) ..... 2006-071112

(51) Int. Cl.
*B41J 29/38* (2006.01)
*B41J 29/393* (2006.01)

(52) U.S. Cl. ..... 347/14; 347/19

(58) Field of Classification Search ..... 347/14, 347/19

See application file for complete search history.

(56) References Cited

U.S. PATENT DOCUMENTS

| | | | | |
|---|---|---|---|---|
| 6,239,817 | B1 * | 5/2001 | Meyer | 347/36 |
| 2003/0095163 | A1 * | 5/2003 | Otsuki et al. | 347/19 |
| 2004/0119768 | A1 * | 6/2004 | Endo | 347/14 |
| 2004/0223022 | A1 * | 11/2004 | Endo | 347/19 |
| 2004/0246285 | A1 * | 12/2004 | Endo | 347/14 |
| 2004/0247364 | A1 * | 12/2004 | Endo | 400/579 |
| 2006/0033769 | A1 * | 2/2006 | Flotats et al. | 347/19 |
| 2006/0033795 | A1 * | 2/2006 | Yokoi | 347/104 |
| 2006/0169161 | A1 * | 8/2006 | Endo | 101/484 |
| 2006/0214985 | A1 * | 9/2006 | Endo | 347/37 |

FOREIGN PATENT DOCUMENTS

| | | |
|---|---|---|
| JP | 10-044390 | 2/1998 |
| JP | 2004-009529 | 1/2004 |
| JP | 2004-090316 | 3/2004 |
| JP | 2004-243741 | 9/2004 |
| JP | 2005-088303 | 4/2005 |

* cited by examiner

*Primary Examiner*—Julian D Huffman
(74) *Attorney, Agent, or Firm*—Nutter McClennen & Fish LLP; John J. Penny, Jr.; Rory P. Phieffer

(57) ABSTRACT

A recording apparatus detects a leading edge of a recording material to be transported in a sub-scanning direction, and performs recording on a recording region of the recording material with reference to the leading edge. When a margin is formed at least at a leading end of the recording material, recording is performed on the recording region with reference to a center leading edge of the recording material. When a margin is not formed at least at the leading end of the recording material, recording is performed on the recording region with reference to one of right and left leading edges of the recording material that precedes in the sub-scanning direction.

4 Claims, 15 Drawing Sheets

RECORDING APPARATUS AND METHOD

BACKGROUND

This application is based on Japanese Patent Application No. 2006-71112 filed on Mar. 15, 2006, in Japanese Patent Office, the entire content of which is hereby incorporated by reference.

1. Technical Field

The present invention relates to a recording apparatus and a recording method for performing recording on a recording region of a transported recording material with reference to a detected leading edge of the recording material. More particularly, the invention relates to a recording apparatus and a recording method for performing recording with reference to a leading edge detected in accordance with a margin provided on the recording material.

2. Related Art

In a recording apparatus that records images and characters on a recording material such as paper, a leading edge of a recording sheet supplied from a sheet supply is detected, and recording is performed on a recording region that has a predetermined positional relationship with the leading edge. An optical sensor is known as means for detecting the leading edge of the recording sheet. The optical sensor includes a light-emitting element for emitting light to the recording sheet and a light-receiving element for receiving reflected light. JP-A-2004-90316 discloses an ink jet recording apparatus in which a recording head and an optical sensor are mounted on a carriage.

In this ink jet recording apparatus, images and so on are recorded by ejecting ink droplets from the recording head onto a surface of a recording sheet while repeating an operation of reciprocating the carriage in a main scanning direction of the recording sheet and an operation of transporting the recording sheet in a sub-scanning direction by a predetermined feeding amount. For printing, in a state in which the carriage stands by at a position through which the leading edge of the transported recording sheet passes, the leading edge crossing a detection range of the optical sensor is detected while transporting the recording sheet. Then, ink droplets are ejected from the recording head onto a recording region that has a predetermined positional relationship with the detected leading edge.

In these operations, it is preferable that the optical sensor detect the leading edge of the recording sheet at a position where the leading edge reliably passes, regardless of the size of the recording sheet. For that purpose, a guide mechanism that allows the recording sheet to be transported along one side of a feeding path is provided in some recording apparatuses. In these recording apparatuses, the leading edge of the recording sheet is detected on one side, generally, on the left side, as viewed from the upstream side in the sub-scanning direction.

Unfortunately, the above-described related art has the following problems. During transportation, the recording sheet is sometimes skewed in the sub-scanning direction, for example, because of friction in the feeding path. When skewing occurs, a margin provided around a recording region does not have a uniform width. Alternatively, although recording should be performed so as not to form a margin, a margin is formed outside a range in which ink is ejected from the recording head.

Further, the direction in which skewing occurs is not fixed, and the recording sheet can be skewed to both the right and left in the sub-scanning direction. In this case, when the left leading edge of the recording sheet is detected, as described above, the size of the margin seriously changes in accordance with the direction of skewing.

SUMMARY

An advantage of some aspects of the invention is that a recording apparatus and a recording method can minimize the change of a margin even when a recording sheet is skewed.

A recording apparatus according to an aspect of the invention detects a leading edge of a recording material to be transported in a sub-scanning direction and performs recording on a recording region of the recording material with reference to the leading edge. When a margin is formed at least at a leading end of the recording material, recording is performed on the recording region with reference to a center leading edge of the recording material. When a margin is not formed at least at the leading end of the recording material, recording is performed on the recording region with reference to a preceding one of right and left leading edges of the recording material, the preceding one of right and left leading edges preceding in the sub-scanning direction.

In this case, the leading edge of the recording material, which is most unsusceptible to skewing, is detected according to the presence or absence of a margin, and recording is performed on the recording region with reference to the detected leading edge. This can minimize the change of the margin caused by skewing.

Preferably, the recording apparatus includes a carriage that reciprocates on the recording material in a main scanning direction orthogonal to the sub-scanning direction; and a first recording-sheet sensor provided in the carriage so as to detect the leading edge and right and left side edges of the recording material. The first recording-material sensor detects the right and left side edges of the recording material when the carriage moves on the recording material in the main scanning direction, and detects the center leading edge of the recording material on the basis of the detected right and left side edges, or detects the preceding one of right and left leading edges of the recording material on the basis of the right and left side edges.

In the recording apparatus, the leading edge, at which the width of the margin negligibly varies, is detected in accordance with the size of the recording material by detecting both side edges of the recording material, and recording is performed on the recording region of the recording material with reference to the detected leading edge. This can minimize the influence of skewing, regardless of the size of the recording material.

BRIEF DESCRIPTION OF THE DRAWINGS

The invention will be described with reference to the accompanying drawings, wherein like numbers reference like elements.

DESCRIPTION OF EXEMPLARY EMBODIMENTS

Embodiments of the invention will be described below with reference to the drawings. It should be noted that the technical scope of the invention is not limited to these embodiments and encompasses matters described in the claims and equivalents thereof.

Figure 1:
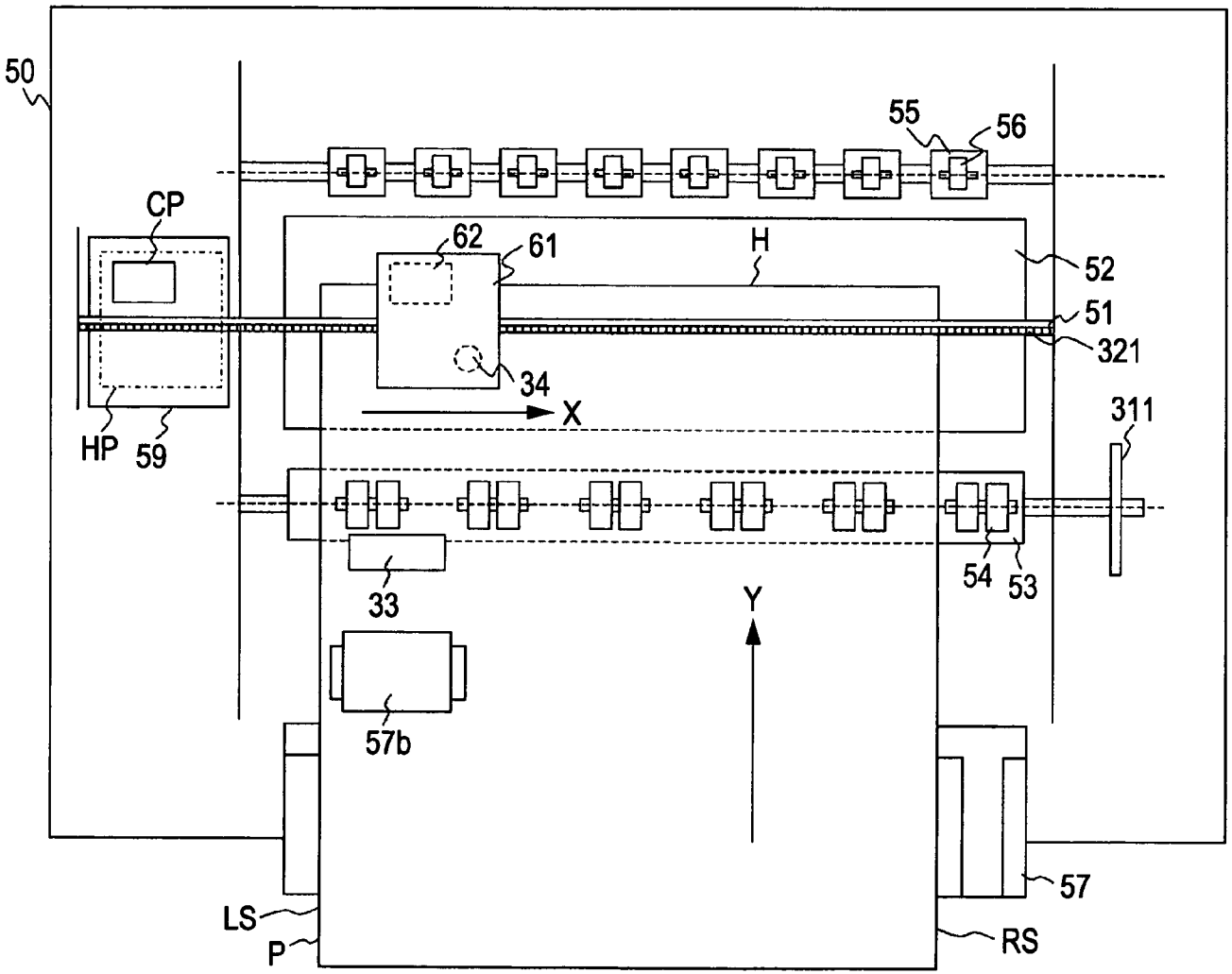
FIG. 1 is a plan view of the principal part of an ink jet recording apparatus according to an embodiment of the invention.
Figure 2:
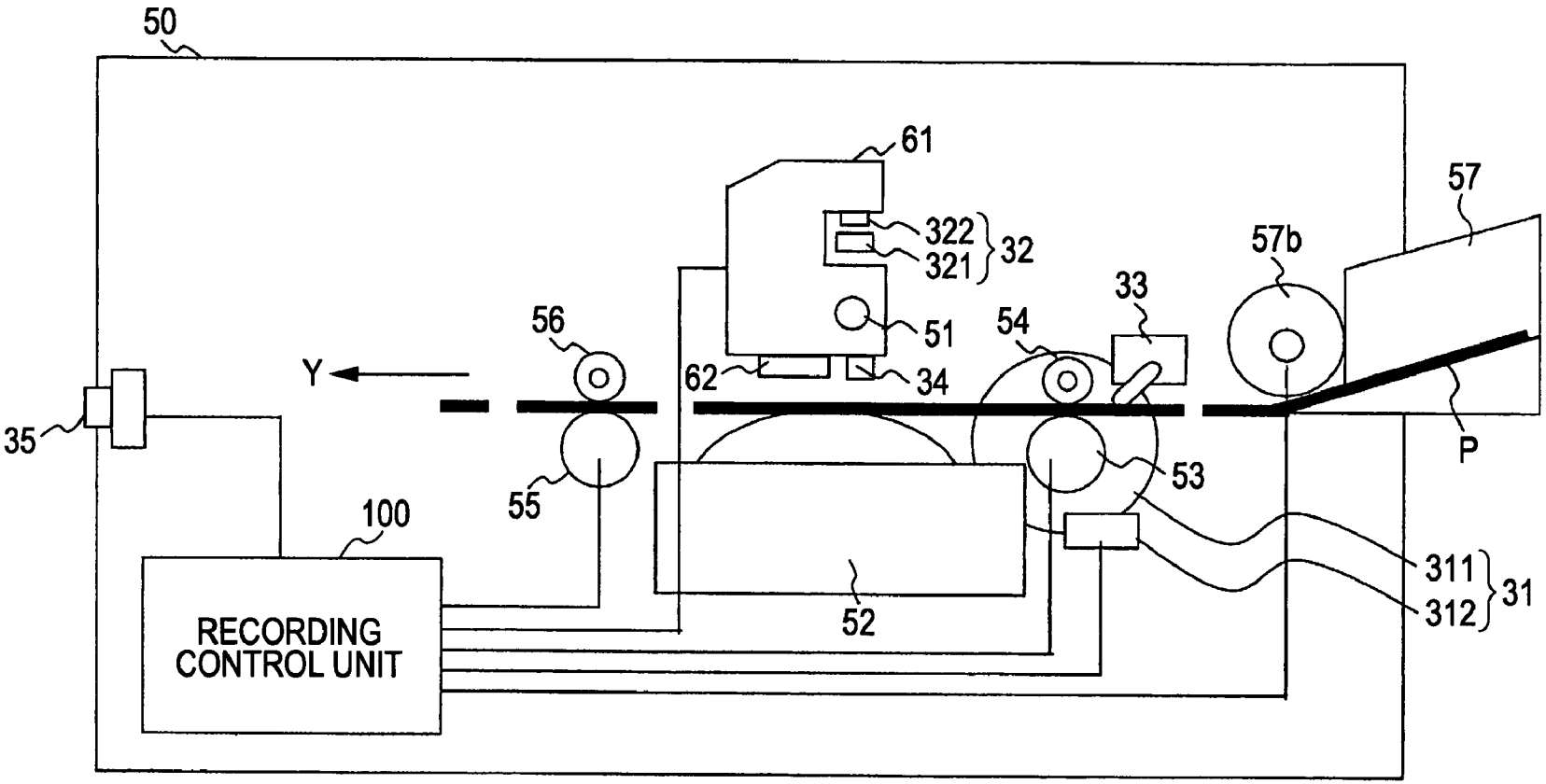
FIG. 2 is a side view of the ink jet recording apparatus.

FIGS. 1 and 2 are a plan view and a side view, respectively, of the principal part of an ink jet recording apparatus 50 according to an embodiment of the invention.

In the ink jet recording apparatus 50, a carriage 61 is provided as means for performing recording on a recording sheet P. The carriage 61 reciprocates in a main scanning direction X along a carriage guide shaft 51. A recording head 2 for ejecting ink onto the recording sheet P and a recording-sheet sensor 34, which will be described below, are mounted on the carriage 61. A platen 52 is provided opposed to the recording head 62. The platen 52 supports the recording sheet P in sliding contact therewith during transportation, and allows a predetermined space to be maintained between a recording surface of the recording sheet P and a head surface of the recording head 62.

Recording is conducted on the recording sheet P by alternately repeating an operation of transporting the recording sheet P by a predetermined feeding amount in a sub-scanning direction Y between the carriage 61 and the platen 52 and an operation of ejecting ink from the recording head 62 onto the recording sheet P while moving the recording head 62 in the main scanning direction X.

The recording-sheet sensor 34 mounted on the carriage 61 is an optical sensor including a light-emitting portion formed of a light emitting diode and a light-receiving portion formed of a phototransistor. The recording-sheet sensor 34 detects a leading edge H, a left side edge LS, or a right side edge RS by receiving light, which is emitted from the light-emitting portion and is reflected by the recording sheet P or the platen 52, with the light-receiving portion and detecting the change in output voltage in accordance with the amount of received light.

Since the recording-sheet sensor 34 is provided on the upstream side of the recording head 62 in the sub-scanning direction Y, it can detect the leading edge of the recording sheet P on the upstream side of a recording region of the recording head 62 in the sub-scanning direction Y while the recording sheet P is transported in the sub-scanning direction Y.

A known capping device 59 is provided outside one end of a region in which the carriage 61 reciprocates in the main scanning direction X. In a standby state when recording is not performed, the carriage 61 moves and stops above the capping device 59, and the recording head 62 is sealed with a cap CP provided in the capping device 59. The stop position of the carriage 61 is defined as a home position HP.

Near the carriage guide shaft 51, a linear scale 321 extends substantially parallel to the main scanning direction X. Slits provided at regular intervals on the linear scale 321 are detected by a linear scale sensor 322 mounted on the carriage 61. An output signal from the linear scale sensor 322 varies in accordance with the moving amount of the carriage 61 in the main scanning direction X, and is transmitted to a recording control unit 100. The linear scale 321 and the linear scale sensor 322 constitute a linear encoder 32 for detecting the moving amount of the carriage 61.

The ink jet recording apparatus 50 also includes a feeding driving roller 53 and a plurality of feeding driven rollers 54 serving as means for transporting the recording sheet P in the sub-scanning direction Y. The feeding driving roller 53 is rotated by the rotating force of a stepping motor so as to feed the recording sheet P in the sub-scanning direction Y. When the recording sheet P is transported by the feeding driving roller 53, the feeding driven rollers 54 rotate in contact with the recording sheet P while following the transportation of the recording sheet P. The recording sheet P is pressed against an outer peripheral surface of the feeding driving roller 53 by the feeding driven rollers 54, and is transported in the sub-scanning direction Y while being in tight contact with the outer peripheral surface of the feeding driving roller 53.

A sheet tray 57 in which multiple recording sheets P can be stacked is provided on the upstream side of the feeding driving roller 53 in the sub-scanning direction Y. A sheet supply roller 57*b* is provided on one side of the sheet tray 57, and is rotated by a stepping motor. By the rotation of the sheet supply roller 57*b*, recording sheets P are supplied from the sheet tray 57 one by one. The sheet tray 57 guides the recording sheet P so as to feed the recording sheet P along the left end of a feeding path, as viewed from the upstream side in the sub-scanning direction Y.

Near the feeding driving roller 53, a rotary scale 311 and a rotary scale sensor 312 are provided. The rotary scale 311 corotates with the feeding driving roller 53, and the rotary scale sensor 312 detects slits provided at regular intervals on the outer periphery of the rotary scale sensor 311. An output signal from the rotary scale sensor 312 varies with the rotation of the feeding driving roller 53, and is transmitted to the recording control unit 100. The rotary scale sensor 311 and the rotary scale sensor 312 constitute a rotary encoder 31 for detecting the rotation speed of the feeding driving roller 53.

A known type of sheet detector 33 is provided between the sheet supply roller 57*b* and the feeding driving roller 53. The sheet detector 33 has a lever that turns in the feeding direction of the recording sheet P. When the leading end of the lever is pushed by the leading edge of the recording sheet P, the lever is turned, and the recording sheet P is thereby detected. That is, the sheet detector 33 is a contact sensor. The rotation of the feeding driving roller 53 is controlled so that the leading edge of the recording sheet P reaches a predetermined position below the carriage 61 after the recording sheet P is transported by a predetermined amount from the time when the leading edge of the recording sheet P supplied by the sheet supply roller 57*b* is detected by the sheet detector 33.

The ink jet recording apparatus 50 also includes a plurality of sheet-ejection driving rollers 55 and a plurality of sheet-ejection driven rollers 56 serving as means for ejecting the recording sheet P after recording. The sheet-ejection driving rollers 55 are rotated by the rotating force of a stepping motor so as to eject the recording sheet P in the sub-scanning direction Y after recording. When the recording sheet P is ejected by the rotation of the sheet-ejection driving rollers 55, the sheet-ejection driven rollers 56 rotate in contact with the recording sheet P while following the transportation of the recording sheet P. This allows the recording sheet P to be ejected in tight contact with the sheet-ejection driving rollers 55.

The driving of the motor for rotating the sheet supply roller 57*b*, the feeding driving roller 53, and the sheet-ejection driving rollers 55 and the motor for driving the carriage 61 in the main scanning direction X are controlled by the recording control unit 100 that will be described below. Similarly, the recording head 62 ejects ink onto the surface of the recording sheet P under control of the recording control unit 100.

Figure 3:
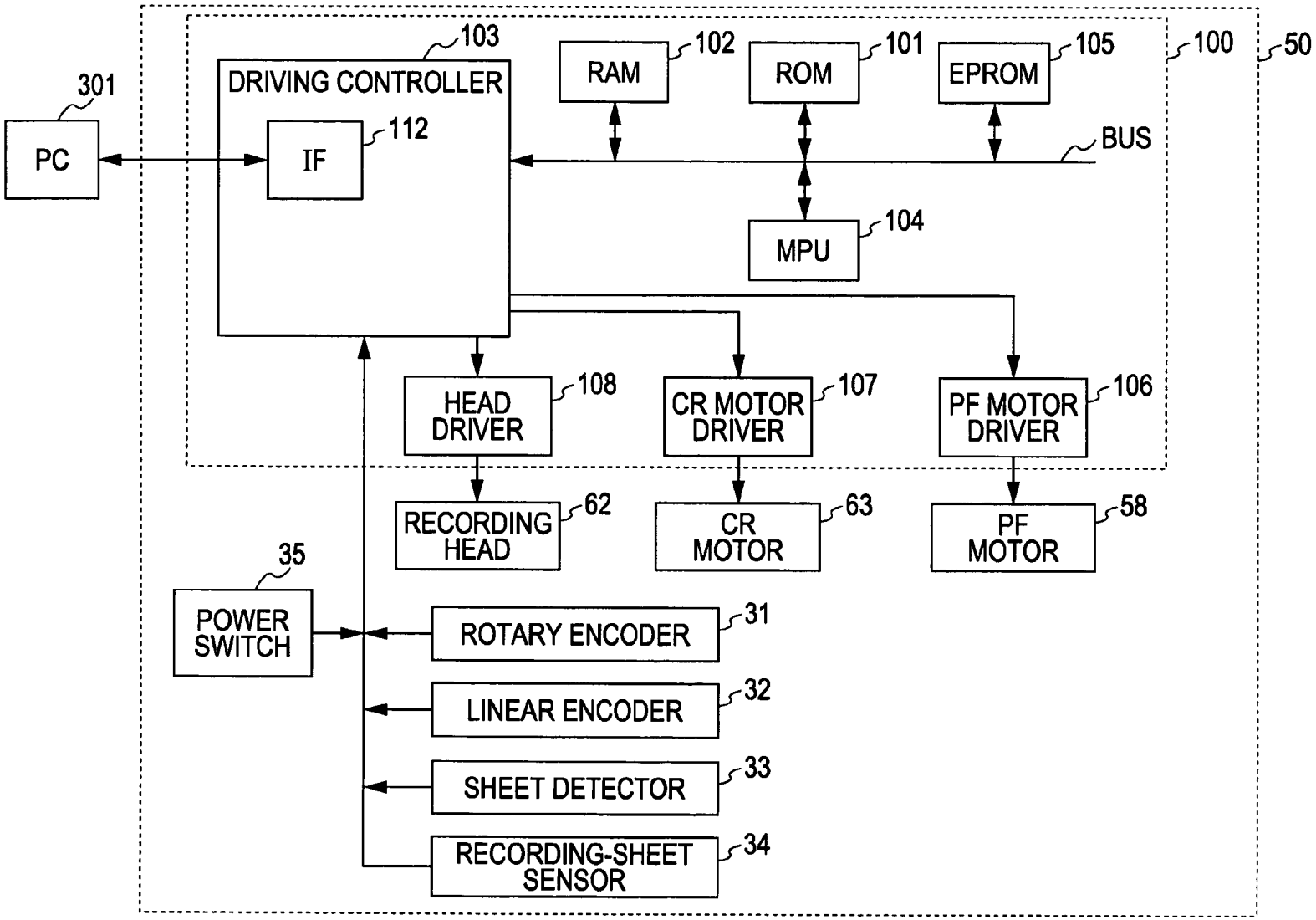
FIG. 3 is a schematic view showing the configuration of a recording control unit in the ink jet recording apparatus.

FIG. 3 is a block diagram showing the configuration of the recording control unit 100 in the ink jet recording apparatus 50. The recording control unit 100 includes a ROM 101, a RAM 102, a driving control circuit 103, a MPU 104, an EPROM 105, a PF motor driver 106, a CR motor driver 107, and a head driver 108. Signals output from the rotary encoder 31 for detecting the rotation speed of the feeding driving roller 53, the linear encoder 32 for detecting the moving amount of the carriage 61, the sheet detector 33 for detecting the leading end of the transported recording sheet P, the recording-sheet sensor 34 for detecting the leading edge H and so on of the recording sheet P, and a power switch 35 for turning on and off the ink jet recording apparatus 50 are input to the MPU 104 via the driving control circuit 103.

The ROM 101, the RAM 102, the driving control circuit 103, the MPU 104, and the EPROM 105 are connected to a system bus BUS of the recording control unit 100. According to a recording control program stored in the ROM 101, the MPU 104 executes processing such as to control recording of the ink jet recording apparatus 50 by using the RAM 102 as a work area. In this case, various data necessary for recording control processing are stored in the EPROM 105.

The driving control circuit 103 is formed of, for example, an application specific integrated circuit, and controls the speeds of a PF motor 58 and a CR motor 63 serving as the stepping motors and controls the driving of the recording head 62. When the rotating force of the PF motor 58 is transmitted to the feeding driving roller 53, the sheet supply roller 57*b*, and the sheet-ejection driving rollers 55, these rollers are rotated, and perform operations of supplying and ejecting the recording sheet P. The rotating force of the CR motor 63 is transmitted to the carriage 61 via a belt transmission mechanism, and the carriage 61 thereby reciprocates in the main scanning direction X.

The driving control circuit 103 also performs various operations for controlling the speeds of the PF motor 58 and the CR motor 63 according to a control command transmitted from the MPU 104, an output signal from the rotary encoder 31, and an output signal from the linear encoder 32. The driving control circuit 103 transmits a motor control signal based on the operation result to the PF motor driver 106 and the CR motor driver 107.

On the basis of a print command received from a host personal computer 301 via an interface 112 provided in the driving control circuit 103, the MPU 104 generates recording data and outputs the data to the driving control circuit 103. The driving control circuit 103 generates a control signal for the recording head 62 by processing on the basis of the recording data input from the MPU 104, and transmits the control signal to the head driver 108 so as to control the driving of the recording head 62. The recording data is stored in an external storage unit such as a memory card (not shown) or the EPROM 105. The MPU 104 can acquire and transmit the recording data to the driving control circuit 103.

Figure 4A:
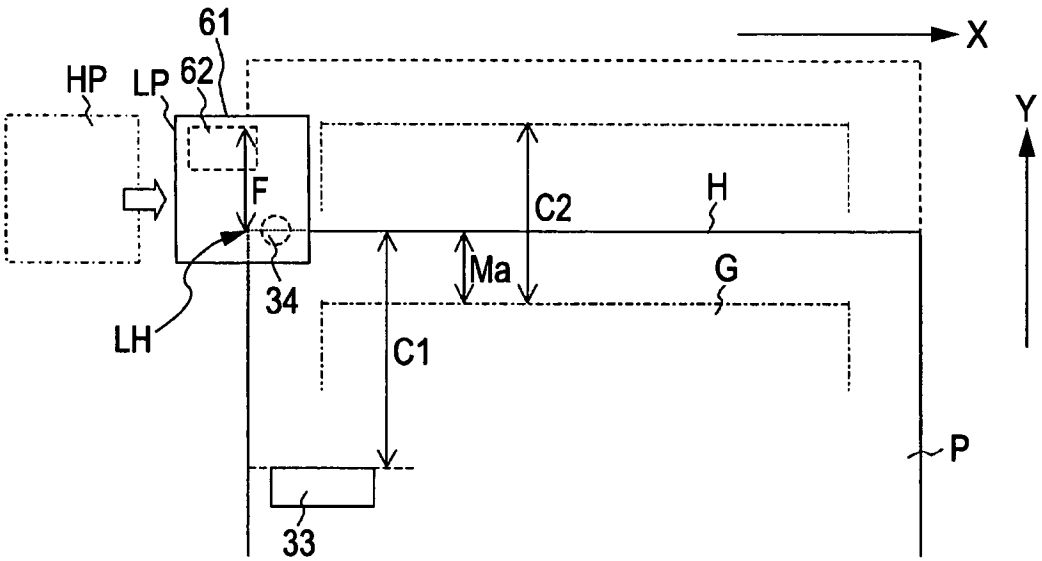
FIGS. 4A and 4B are schematic views showing an operation of detecting a leading edge of a recording sheet in the ink jet recording apparatus and performing recording with reference to the detected leading edge.
Figure 4B:
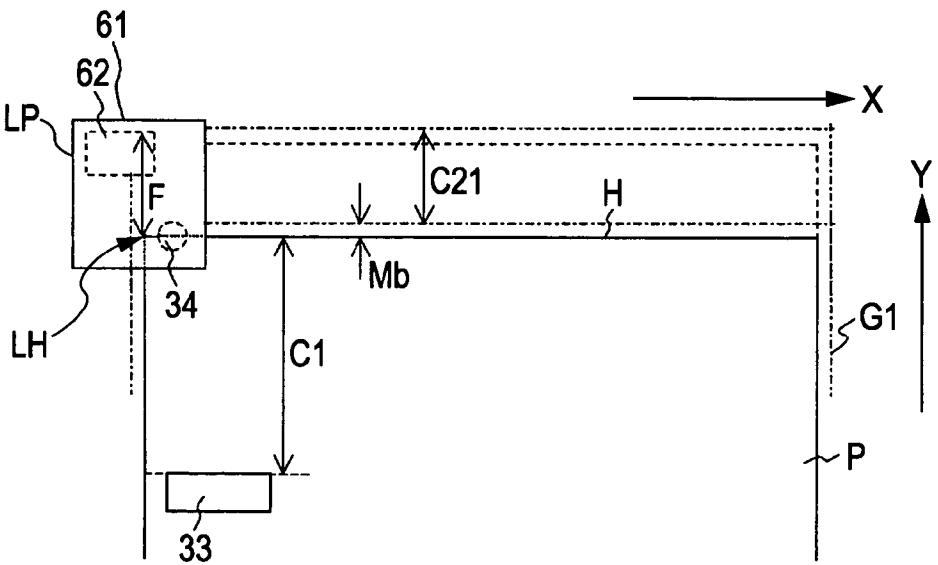

FIGS. 4A and 4B are schematic views showing an operation of detecting the leading edge of a recording sheet P and performing recording with reference to the detected leading edge in the ink jet recording apparatus 50. The motion of the carriage 61 and transportation of the recording sheet P shown in FIG. 1 will be described below.

FIG. 4 shows a case in which recording is performed so as to form a margin at the leading end of a recording sheet P. First, the carriage 61 moves from the home position HP in the main scanning direction X, and stands by at a predetermined position LP where a leading edge H of the recording sheet P passes certainly. On the other hand, the recording sheet P is transported in the sub-scanning direction Y, and passes through a light-receiving region of the recording-sheet sensor 34 mounted on the carriage 61, so that a left leading edge LH of the recording sheet P is detected.

The MPU 104 calculates the feeding amount of the recording sheet P from the time when the leading edge H is detected by the sheet detector 33, on the basis of output from the rotary encoder 31, and stores, in the RAM 102, a feeding amount C1 needed until the recording-sheet sensor 34 detects the left leading edge LH of the recording sheet P.

Then, the MPU 104 adds a length of Ma of a margin based on the recording data and a distance F between the recording-sheet sensor 34 and the recording head 62, and thereby calculates a feeding amount C2 necessary for a recording region G of the recording sheet P to reach the recording head 62. After the recording sheet P is transported by the feeding amount C2, it is stopped temporarily. By controlling ink ejection from the recording head 62 while moving the carriage 61 in the main scanning direction X, recording is performed on the recording region G of the recording sheet P according to the recording data. In this way, recording is performed on the recording region G with reference to the detected left leading edge LH of the recording sheet P.

FIG. 4B shows a case in which recording is performed without forming a margin at the leading end of a recording sheet P. In this case, in order that ink reliably lands on the leading edge and right and left side edges of the recording sheet P, a recording region G1 is set so that the leading edge and right and left side edges thereof are shifted outside from those of the recording sheet P by a width Mb (a region shown by a one-dot chain line). Therefore, a feeding amount C21, which is necessary for the recording region G1 to reach the recording head 62 in the operation shown in FIG. 4A, is found as a difference between the distance F between the recording-sheet sensor 34 and the recording head 62, and the width Mb. Subsequently, recording is performed with reference to a left leading edge LH of the recording sheet P in a manner similar to that adopted in FIG. 4A.

Since the recording sheet P is transported downstream in the sub-scanning direction Y along the left side of the feeding path, the carriage 61 stands by at the left end LP of the recording sheet P where the recording sheet P certainly passes, regardless of the size of the recording sheet P, and the left leading edge LH of the recording sheet P is detected at that position. In this case, when the recording sheet P is skewed in the sub-scanning direction Y, the following problems occur.

Figure 5A:
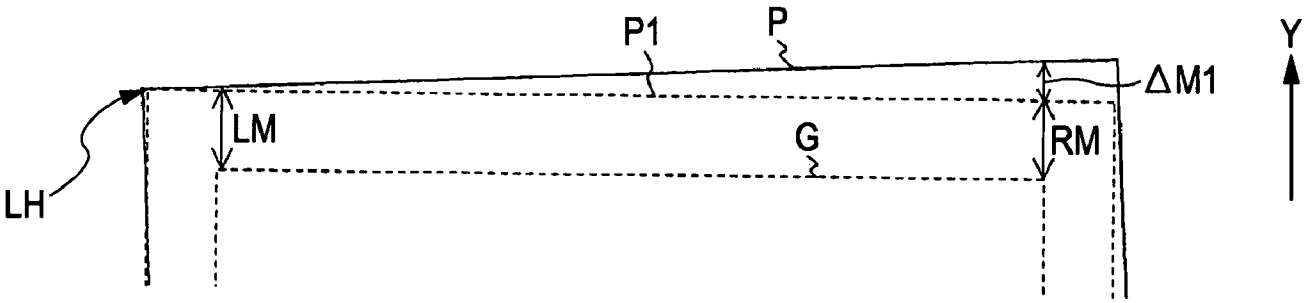
FIGS. 5A, 5B, and 5C are explanatory views showing problems caused by skewing of a recording sheet when recording is performed with reference to a left leading edge of the recording sheet.
Figure 5B:
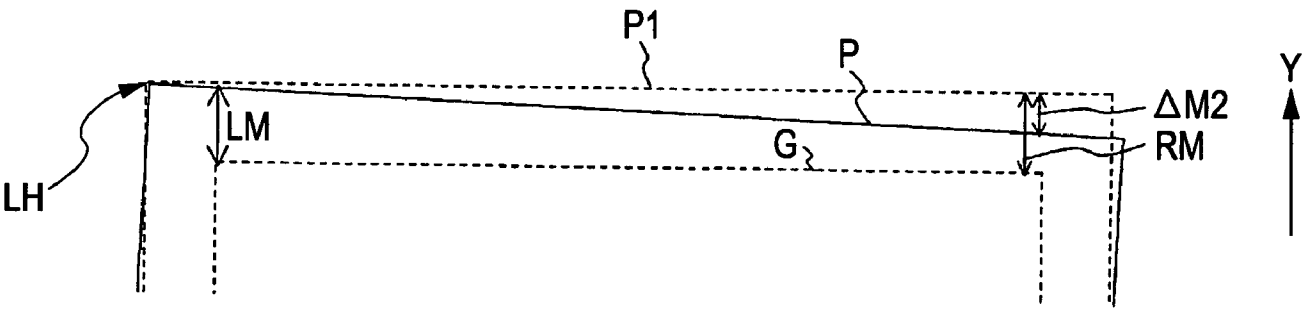
Figure 5C:
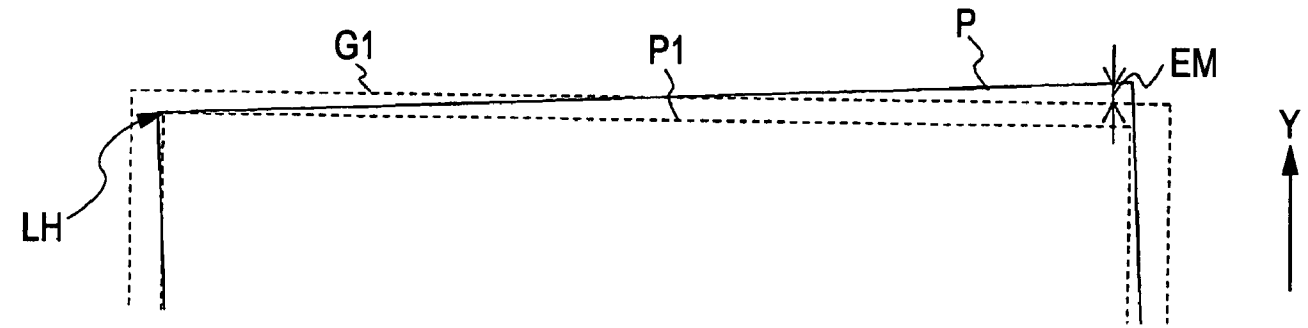

FIGS. 5A to 5C show problems caused by skewing of a recording sheet P when recording is performed with reference to the left leading edge LH of the recording sheet P. In the following description, the right and left refer to the right and left sides, as viewed from the upstream side in the sub-scanning direction Y.

FIG. 5A shows a case in which recording is performed so as to form a margin at the leading end of a recording sheet P, and the recording sheet P is skewed to the left. When a left leading edge LH of the recording sheet P is detected and recording is performed on a recording region G of a recording sheet P1 which is not skewed, as shown in FIG. 4A, a margin RM formed on the right side is wider than a margin LM on the left side by a width ΔM1, because the recording sheet P is skewed in actuality.

Conversely, in a case in which the recording sheet P is skewed to the right, as show in FIG. 5B, recording is performed on the recording region G of the unskewed recording sheet P1, and a margin RM on the right side is thinner than a margin LM on the left side by a width ΔM2.

FIG. 5C shows a case in which recording is performed so as not to form a margin. When an image is recorded with no margin, recording is performed on a recording region G1 that is slightly larger than the unskewed recording sheet P1 in order for ink to land reliably. When the recording sheet P is skewed with its right leading edge out of the recording region G1, ink does not land on the right leading edge, and an undesired margin EM is formed.

In order to overcome the above-described problems, a leading edge H of the recording sheet P is detected in the following manner in the ink jet recording apparatus 50 according to this embodiment.

Figure 6A:
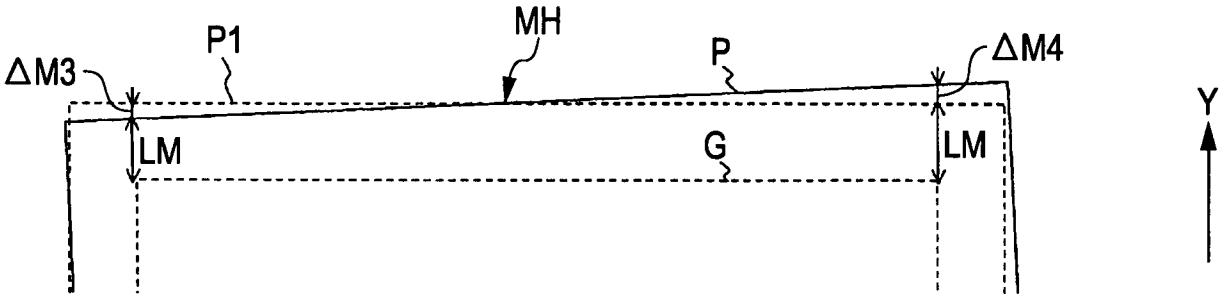
FIGS. 6A, 6B, and 6C are explanatory views showing states in which the leading edge of the recording sheet is detected at different positions in accordance with a margin in the ink jet recording apparatus.
Figure 6B:
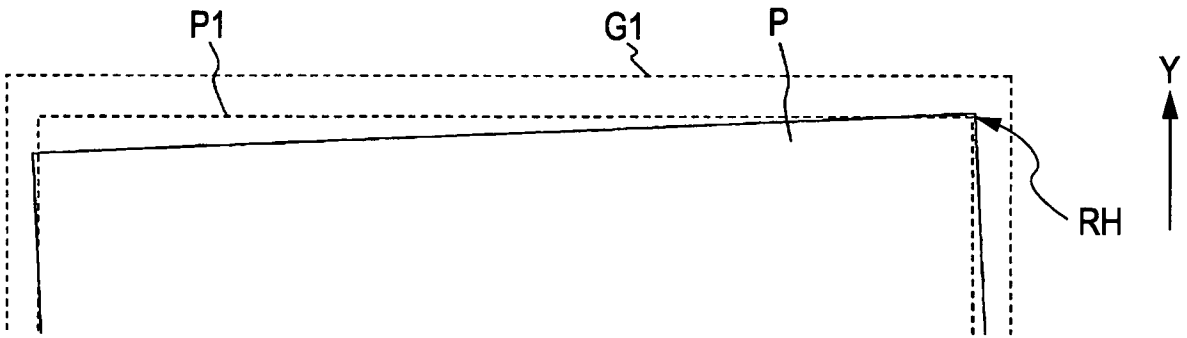
Figure 6C:
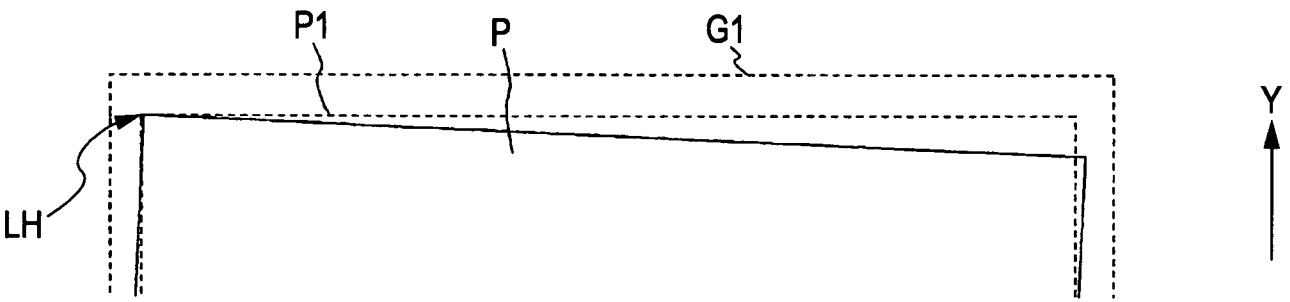

FIGS. 6A to 6C show cases in which the leading edge of a recording sheet P is detected at different positions set in accordance with the margin. FIG. 6A shows a case in which recording is performed so as to form a margin. In this case, a recording sheet P is skewed to the left in the sub-scanning direction Y, and a center leading edge MH of the recording sheet P is detected. Recording is performed on a recording region G of an unskewed recording sheet P1. As a result, a margin LM at the leading left end of the recording sheet P is formed to be thinner by a width ΔM3, and a margin RM at the leading right end is formed to be wider by a width ΔM4. However, the amount of change in width of the margin of the entire recording sheet, that is, the sum of the widths ΔM3 and ΔM4 is less than the width ΔM1 or the width ΔM2 shown in FIG. 5A or 5B by which the width of the margin changes when recording is performed with reference to the left leading edge LH of the recording sheet P.

When recording is performed so as not to form a margin, as shown in FIGS. 6B and 6C, one of the right and left leading edges of the recording sheet P that precedes in the sub-scanning direction Y is detected, and recording is performed with reference to the detected edge. That is, when a recording sheet P is skewed to the left, as shown in FIG. 6B, the preceding right leading edge RH is detected, and recording is performed with reference to the right leading edge RH on a recording region G1 of an unskewed recording sheet P1. This allows ink to reliably land on the leading edge of the recording sheet P. In contrast, when the recording sheet P is skewed to the right, as shown in FIG. 6C, the preceding left leading edge LH of the recording sheet P is detected, and recording is performed with reference to the left leading edge LH on the recording region G1 of the unskewed recording sheet P1. This allows ink to reliably land on the leading edge of the recording sheet P.

In this way, in the ink jet recording apparatus according to the embodiment, the leading edge of the recording sheet is detected at different positions set in accordance with a margin of an image to be recorded, and recording is performed on the recording region with reference to the detected leading edge. This minimizes the change of the margin of the recorded image.

Figure 7:
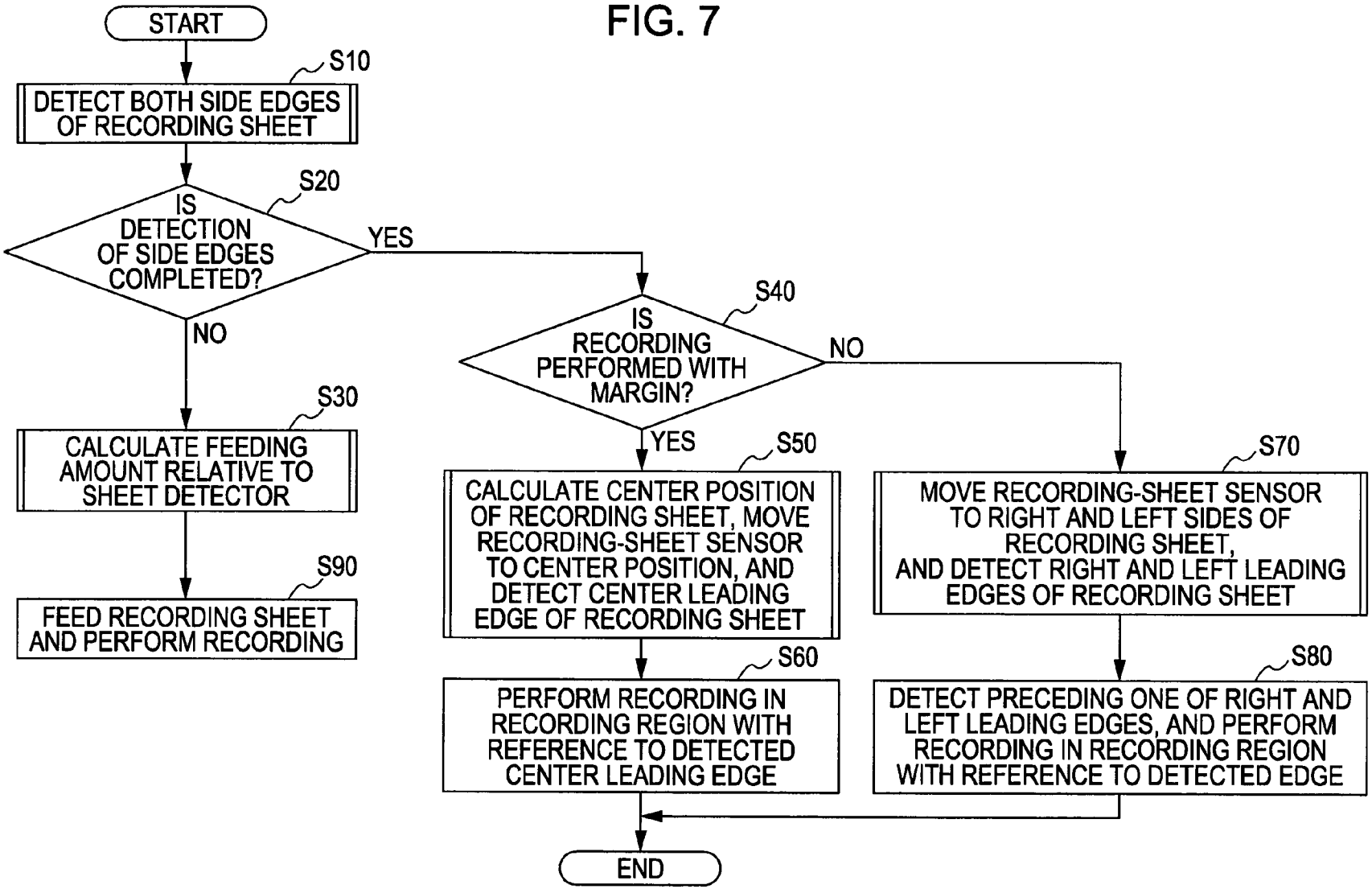
FIG. 7 is a flowchart of a procedure performed in the ink jet recording apparatus.

FIG. 7 is a flowchart showing a procedure in which the recording control unit 100 controls the components of the ink jet recording apparatus 50.

First, both side edges of a transported recording sheet P are detected by the recording-sheet sensor 34 (Step S10). In this case, even when the width of the recording sheet P is changed, the positions at which the recording-sheet sensor 34 detects the center leading edge or the right and left leading edges can be determined. When the side edges are detected (YES in Step S20), it is determined according to recording data whether recording is performed so as to form a margin (Step S40).

When a margin is formed (YES in Step S40), the position of the center of the recording sheet P is calculated, the recording-sheet sensor 34 is moved to the center, and the center leading edge of the recording sheet P is detected (Step S50). Then, recording is performed on the recording region with reference to the center leading edge (Step S60).

In contrast, when a margin is not formed (NO in Step S40), the recording-sheet sensor 34 is sequentially moved to the left and right sides of the recording sheet P, and detect the leading left and right edges of the recording sheet P (Step S70). Then, recording is performed on the recording region with reference to one of the right and left leading edges that precedes in the sub-scanning direction Y (Step S80).

When detection of both side edges of the recording sheet P is not completed in Step S20 (NO in Step S20), a feeding amount by which the recording sheet P is transported to a recordable position is calculated on the basis of the detection result by the sheet detector 33, as will be described below. The recording sheet P is transported by the calculated feeding amount, and recording is performed (Step S90).

Figure 8:
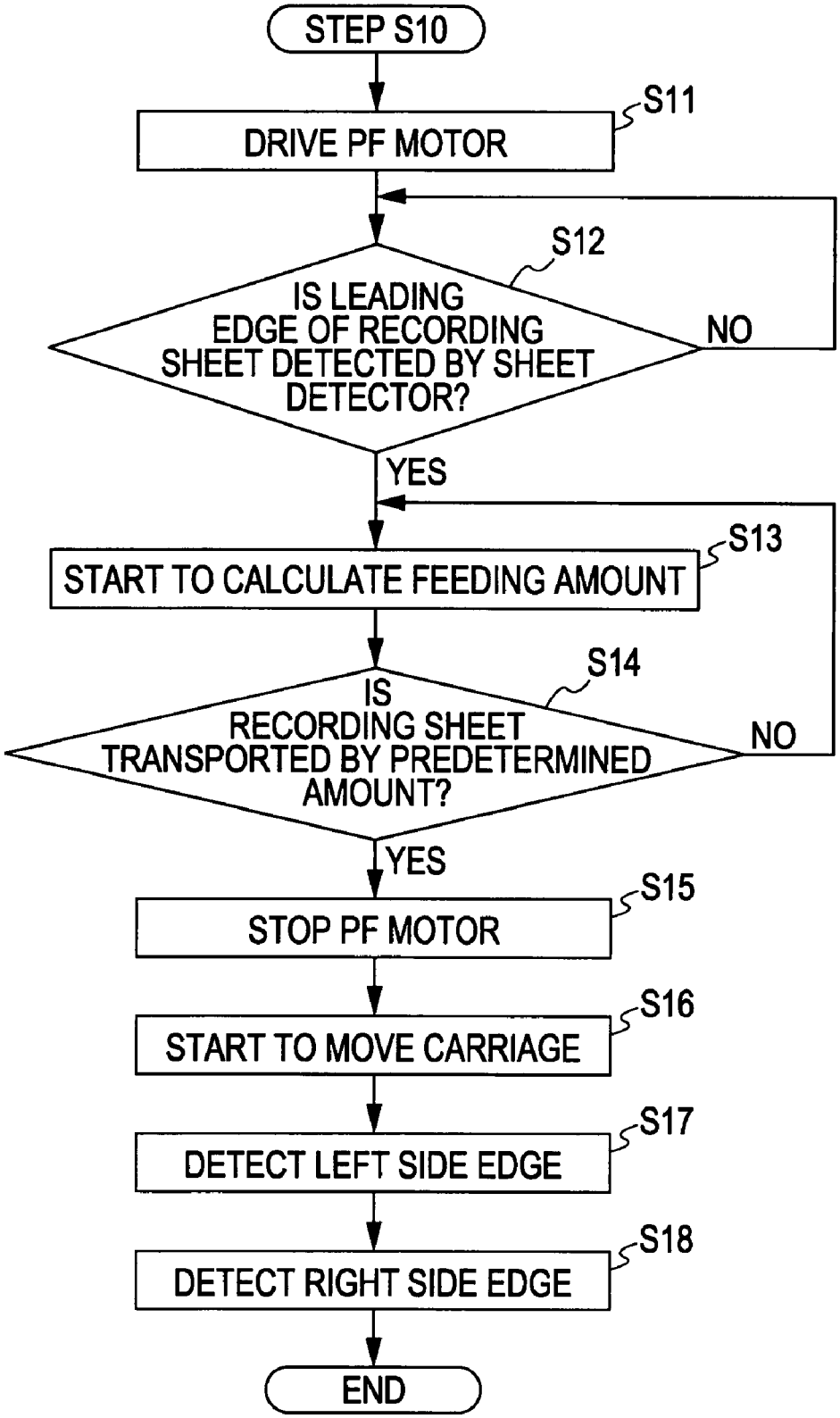
FIG. 8 is a detailed flowchart of a step of detecting both side edges of the recording sheet.

The step of detecting both side edges (Step S10) will now be described in detail with reference to FIGS. 8 and 9. FIG. 8 is a detailed flowchart of Step S10, and FIG. 9 is a schematic view showing the motion of the carriage 61 in Step S10.

First, the recording control unit 100 drives the PF motor 58 so as to feed a recording sheet P from the sheet tray 57 (Step S11 in FIG. 8). When the leading edge of the recording sheet P is detected by the sheet detector 33 (YES in Step S12), the feeding amount is calculated from the output from the linear encoder 32 (Step S13). After the recording sheet P is transported by the feeding amount until the adjacencies of the leading side edges of the recording sheet P reach a position such as to be detected by the recording-sheet sensor 34 (YES in Step S14), the PF motor 58 is stopped at the position (Step S15) to stop the transportation of the recording sheet P.

Figure 9:
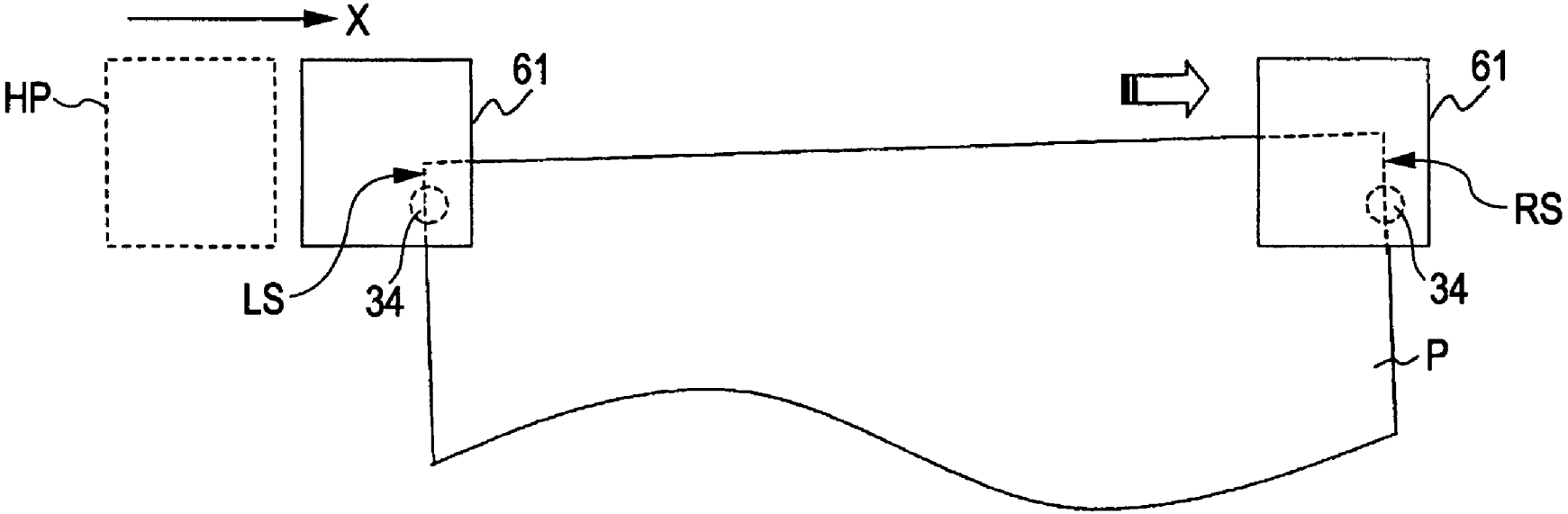
FIG. 9 is a schematic view showing the motion of a carriage in the detecting step.

Then, the recording control unit 100 starts to move the carriage 61, which stands by at the home position HP, in the main scanning direction X (Step S16 in FIG. 8, FIG. 9). When the light-receiving region of the recording-sheet sensor 34 moves across the left side edge LS of the recording sheet P, and detects the left side edge LS (Step S17 in FIG. 8, FIG. 9). While the carriage 61 is continuously moved in the main scanning direction X, the light-receiving region of the recording-sheet sensor 34 moves across the right side edge RS of the recording sheet P, and detects the right side edge RS (Step S18 in FIG. 8, FIG. 9).

As described above, the recording control unit 100 can find the width of the recording sheet P from the difference between the detected side edges LS and RS. Therefore, the positions of the center or the right and left edges of the recording sheet P can be found, regardless of the size of the recording sheet P.

A detailed description will now be given of the step of detecting the center leading edge of the recording sheet P when recording is performed so as to form a margin (Step S50 in FIG. 7) with reference to FIGS. 10 and 11.

Figure 10:
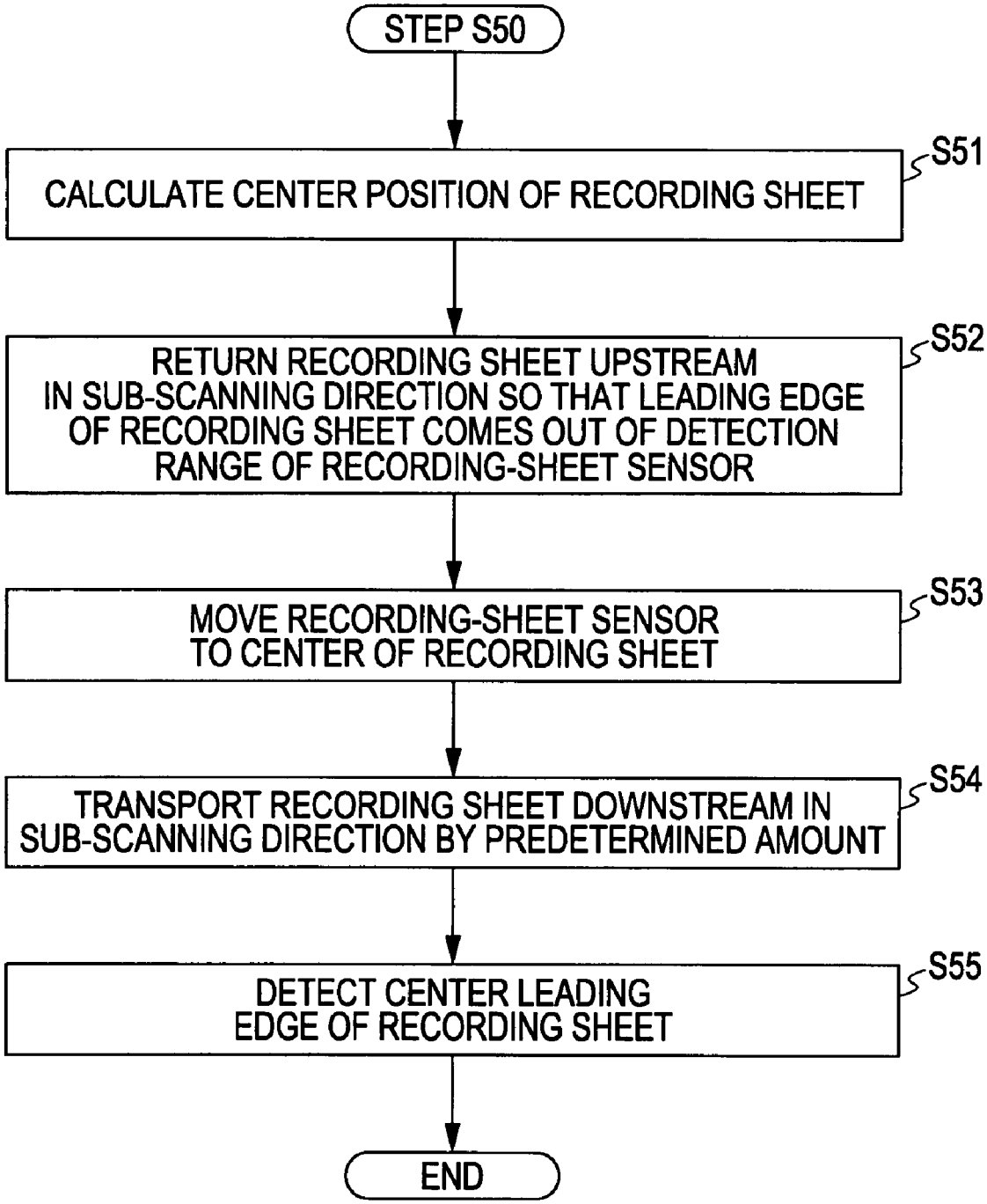
FIG. 10 is a detailed flowchart of a step of detecting the center leading edge of the recording sheet when recording is performed so as to form a margin at the leading end of the recording sheet.
Figure 11:
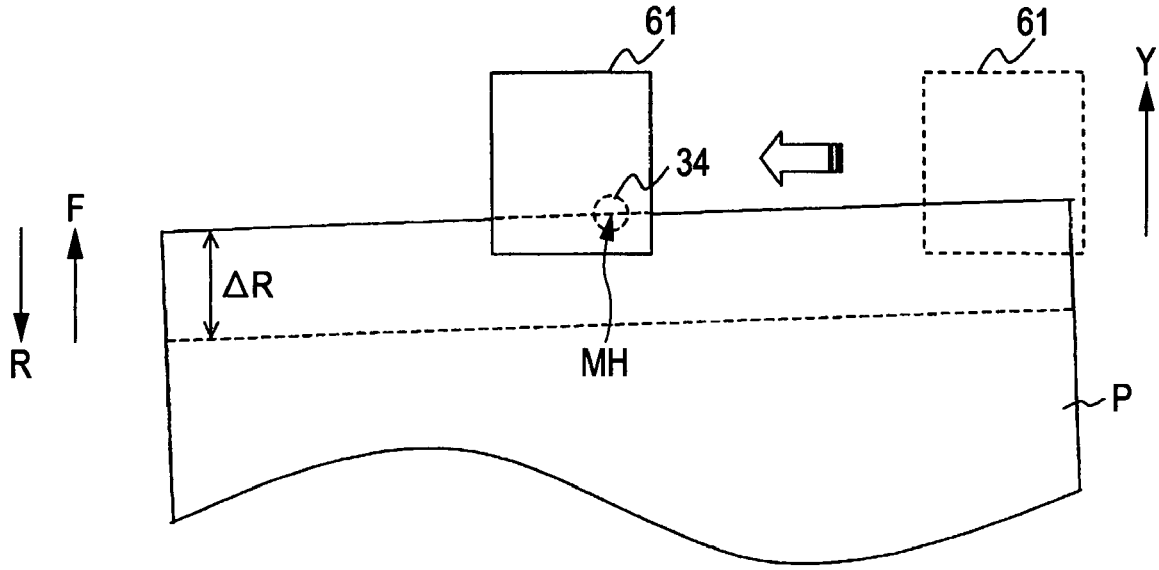
FIG. 11 is a schematic view showing the motion of the carriage for detecting the center leading edge of the recording sheet when recording is performed so as to form a margin at the leading end of the recording sheet.

FIG. 10 is a detailed flowchart of Step S50, and FIG. 11 is a schematic view showing the motion of the carriage 61 in Step S50.

In the recording control unit 100, the MPU 104 first calculates the position of the center of a recording sheet P on the basis of the positions of the side edges of the recording sheet P found in the step shown in FIGS. 8 and 9 (Step S51 in FIG. 10). Then, the recording sheet P is transported upstream in the sub-scanning direction Y by a feeding amount AR so that the leading edge thereof temporarily comes out of a detection range of the recording-sheet sensor 34 (Step S52 in FIG. 10, arrow R in FIG. 11).

Then, the recording control unit 100 moves the carriage 61 so as to place the recording-sheet sensor 34 at the center of the recording sheet P (Step S53 in FIG. 10, FIG. 11). Subsequently, the recording sheet P is transported downstream in the sub-scanning direction Y by the feeding amount that allows the leading edge to be detected by the recording-sheet sensor 34 (Step S54 in FIG. 10, arrow F in FIG. 11). When the leading edge of the recording sheet P moves across the light-receiving region of the recording-sheet sensor 34, a center leading edge MH of the recording sheet P is detected (Step S55 in FIG. 10, FIG. 11).

The center leading edge MH of the recording sheet P is detected, as described above, and recording is performed on the recording region with a margin with reference to the detected center leading edge MH (Step S60 in FIG. 7). Consequently, recording can be performed while minimizing the change in size of the margin.

A detailed description will now be given of the step of detecting the right and left side edges of a recording sheet P when recording is performed so as not to form a margin at the leading end (Step S70 in FIG. 7) with reference to FIGS. 12 and 13.

Figure 12:
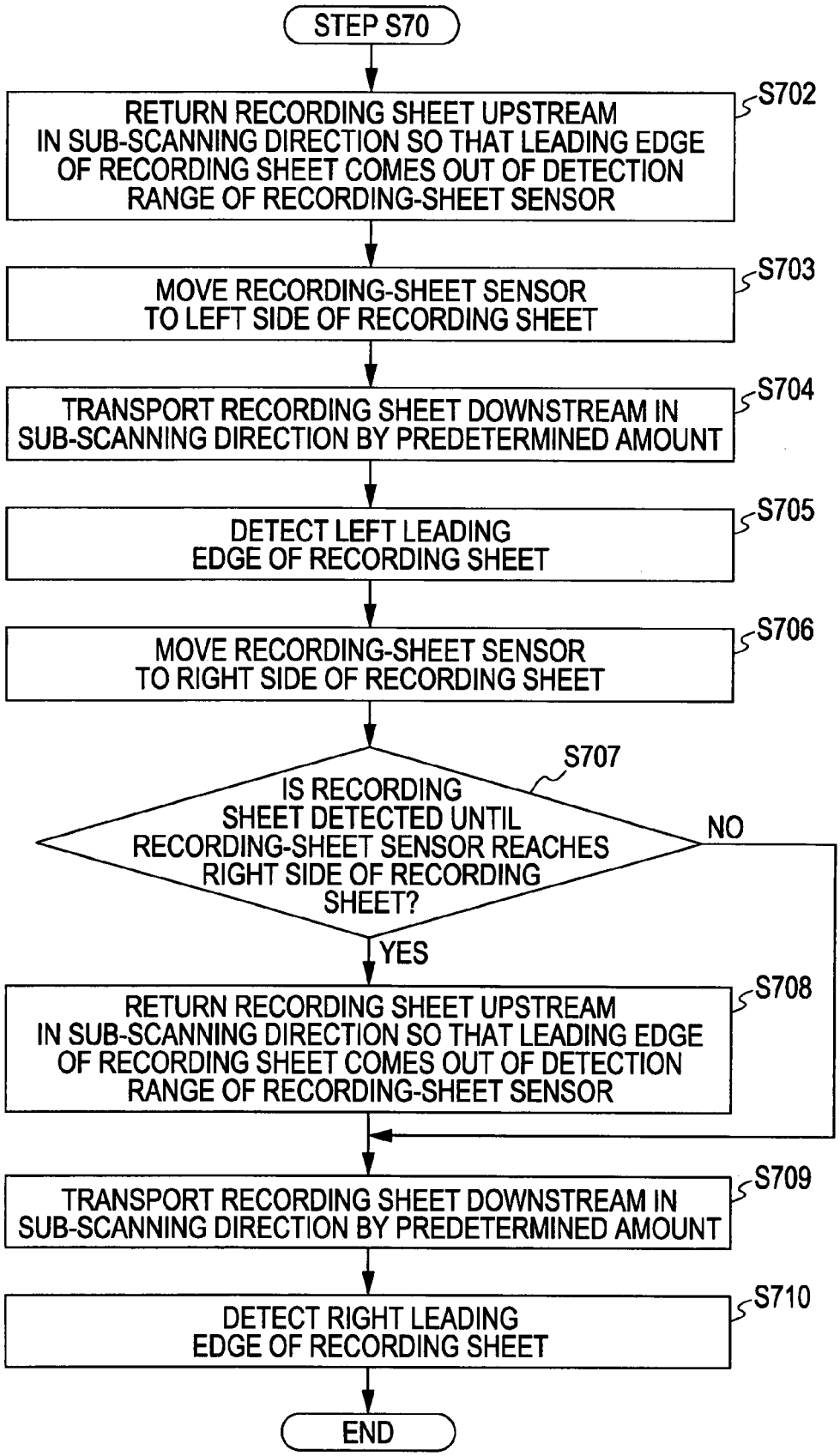
FIG. 12 is a detailed flowchart of a step of detecting right and left leading edges of the recording sheet when recording is performed so as not to form a margin at the leading end of the recording sheet.
Figure 13A:
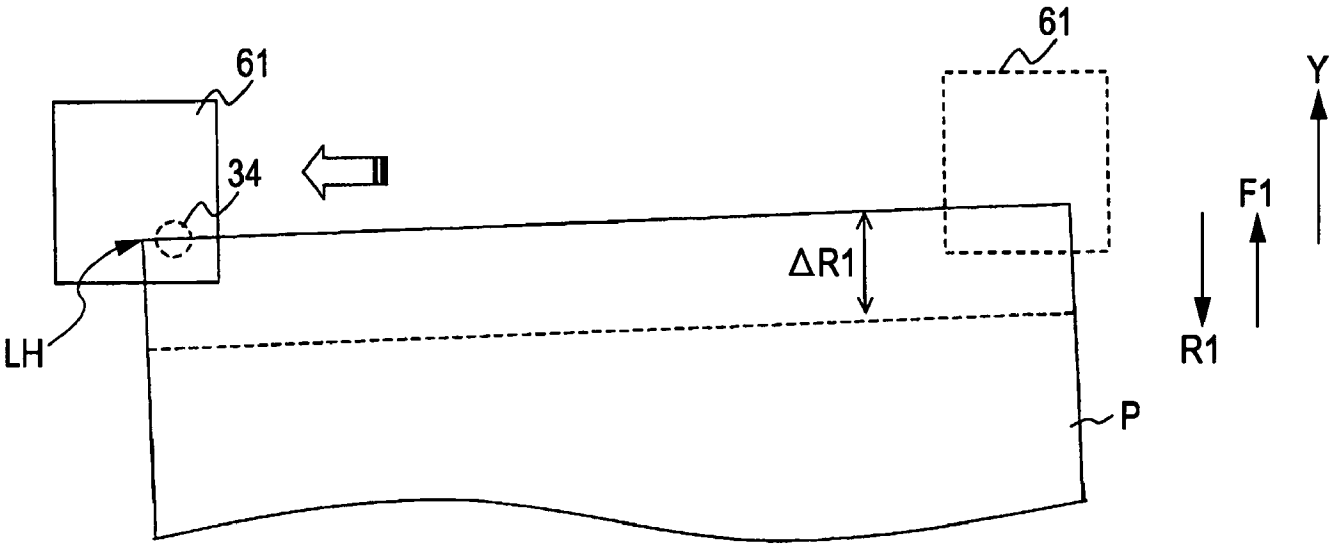
FIGS. 13A and 13B are schematic views showing the motion of the carriage for detecting the right and left leading edges of the recording sheet when recording is performed so as not to form a margin at the leading end of the recording sheet.
Figure 13B:
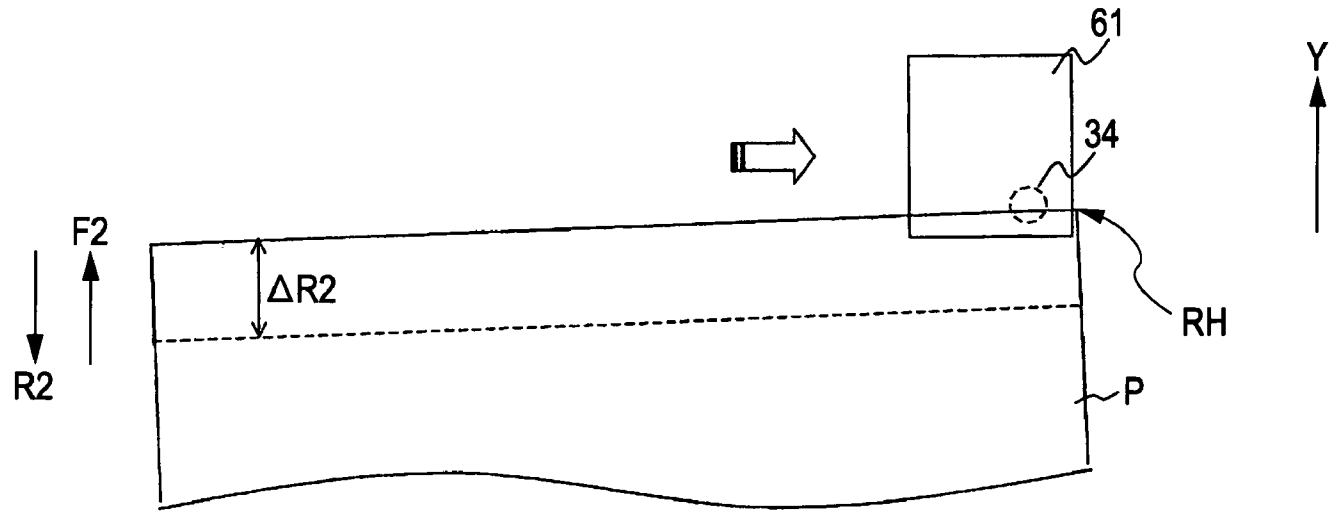

FIG. 12 is a detailed flowchart of Step S70, and FIGS. 13A and 13B are schematic views showing the motion of the carriage 61 in Step S70.

The recording control unit 100 transports a recording sheet P upstream in the sub-scanning direction Y by a feeding amount ΔR1 so that the leading edge of the recording sheet P temporarily comes out of the detection range of the recording-sheet sensor 34 (Step S702 in FIG. 12, arrow R1 in FIG. 13A). Then, the recording control unit 100 moves the carriage 61 on the basis of the positions of the side edges found in the step shown in FIGS. 8 and 9, thereby moving the recording-sheet sensor 34 to the left side of the recording sheet P (Step S703 in FIG. 12, FIG. 13A). Herein, the left side of the recording sheet P refers to the position such that the light-receiving region of the recording-sheet sensor 34 is closer to the center of the recording sheet P than the left side edge of the recording sheet P and such that the left leading edge of the recording sheet P passes through the light-receiving region.

The recording sheet P is transported downstream in the sub-scanning direction Y by the feeding amount that allows the leading edge of the recording sheet P to be detected by the recording-sheet sensor 34 (Step S704 in FIG. 12, arrow F1 in FIG. 13A). When the leading edge of the recording sheet P moves across the light-receiving region of the recording sheet-sensor 34, a left leading edge LH of the recording sheet P is detected (Step S705 in FIG. 12, FIG. 13A).

Subsequently, the recording control unit 100 moves the carriage 61 so as to move the recording-sheet sensor 34 to the right side of the recording sheet P (Step S706 in FIG. 12, FIG. 13B). Herein, the right side of the recording sheet P refers to the position such that the light-receiving region of the recording-sheet sensor 34 is closer to the center of the recording sheet P than the right side edge of the recording sheet P and such that the right leading edge of the recording sheet P passes through the light-receiving region.

In this case, when the recording sheet P is skewed to the left and the right leading edge RH thereof precedes, the recording sheet P is still detected until the recording-sheet sensor 34 reaches the right side of the recording sheet P (YES in Step S707 in FIG. 12). In this case, the recording sheet P is transported upstream in the sub-scanning direction Y by a feeding amount ΔR2 so that the leading edge temporarily comes out of the detection range of the recording-sheet sensor 34 (Step S708 in FIG. 12, arrow R2 in FIG. 13B).

Then, the recording sheet P is downstream in the sub-scanning direction Y again (Step S709 in FIG. 12, arrow F2 in FIG. 13B). When the leading edge of the recording sheet P moves across the light-receiving region of the recording-sheet sensor 34, a right leading edge RH of the recording sheet P is detected (Step S709 in FIG. 12, FIG. 13B).

When the recording sheet P is skewed to the right, the left leading edge LH thereof precedes, and the recording sheet P is not detected by the recording-sheet sensor 34 in Step S707 in FIG. 12 (NO in Step S707). Therefore, there is no need to return the recording sheet P upstream in the sub-scanning direction Y. The recording sheet P is transported downstream in the sub-scanning direction Y, and the right leading edge RH thereof is detected.

As described above, the recording control unit 100 can detect a preceding one of the right and left leading edges of the recording sheet P, and recording is performed with reference to the detected edge so as not to form a margin (Step S80 in FIG. 7). Consequently, recording can be performed with no margin at the leading edge of the recording sheet P.

A description will now be given of the step of finding the feeding amount by which the recording sheet P is transported to the recordable position when the side edges of the recording sheet P are not detected (Step S30 in FIG. 7).

In the recording-sheet sensor 34, light emitted from the light-emitting portion is reflected by the recording sheet P or the platen 52, and the light-receiving portion receives the reflected light, and performs photoelectric conversion. In this case, since the amount of light reflected by the surface of the recording sheet P is more than the amount of light reflected by the surface of the platen 52, the output voltage changes when the reflected light from the recording sheet P is received, and the recording sheet P is detected thereby. Therefore, if there is not much difference in the amount of received light between the recording sheet P and the platen 52 because the surface of the recording sheet P is colored or other recording media are used, the recording sheet P is not detected effectively. In this case, the recording region of the recording sheet P is moved to the recording head 62 in the following manner.

Figure 14:
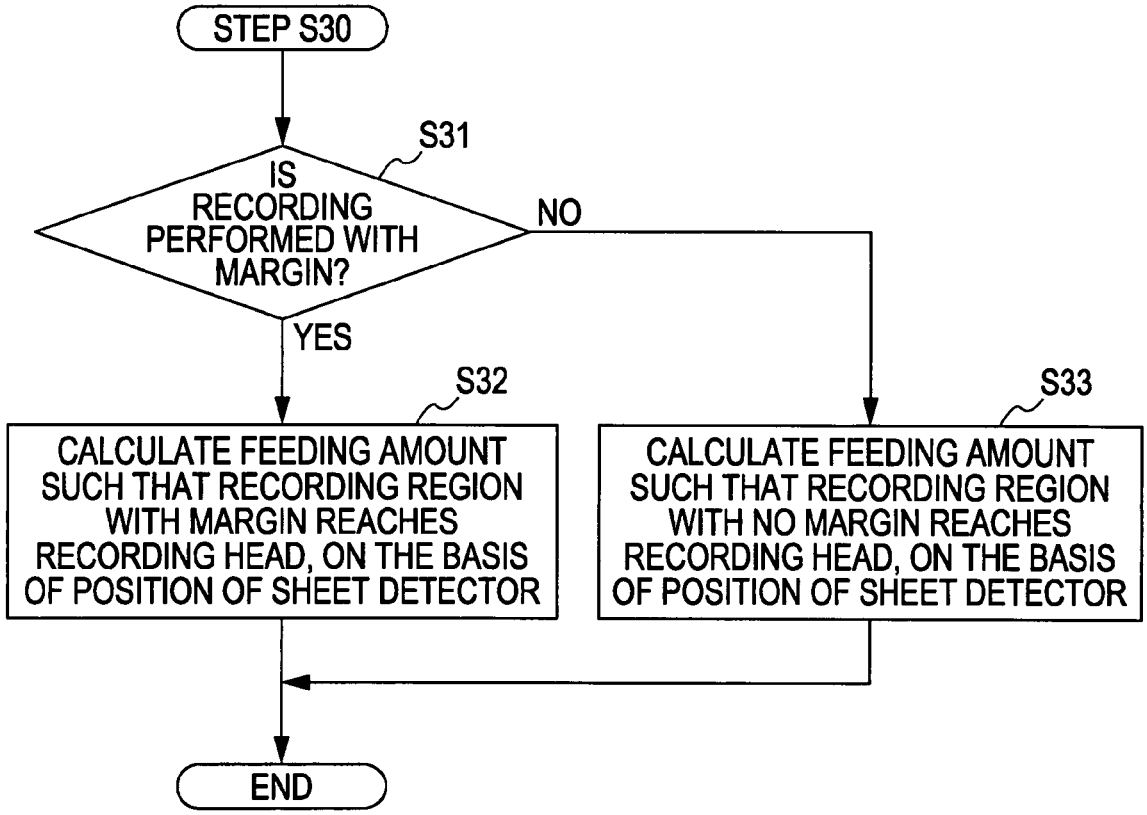
FIG. 14 is a detailed flowchart of a step of calculating the feeding amount of the recording sheet to a recording position when side edges of the recording sheet are not detected.
Figure 15A:
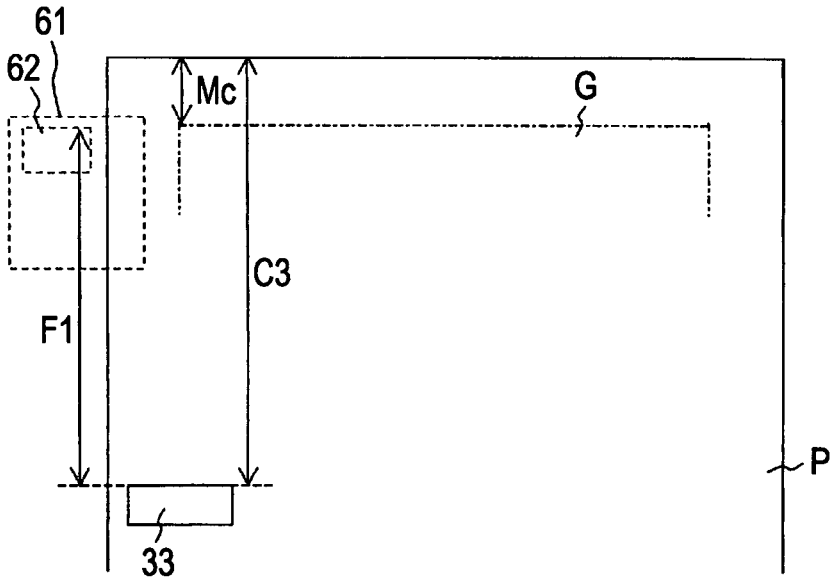
FIGS. 15A and 15B are schematic views showing the feeding amount by which the recording sheet is transported to the recording position.
Figure 15B:
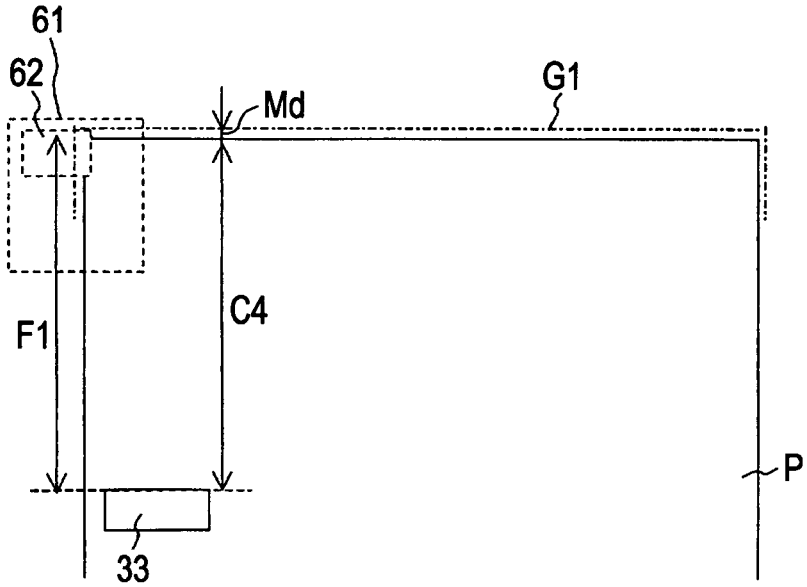

FIG. 14 is a detailed flowchart of Step S30 for finding the feeding amount by which the recording sheet P is transported to the recordable position when the side edges of the recording sheet P are not detected. FIGS. 15A and 15B are schematic views showing the feeding amount.

When detecting both side edges of a recording sheet P with the recording-sheet sensor 34, the recording control unit 100 transports the recording sheet P by a predetermined feeding amount from the time when the leading edge of the recording sheet P is detected by the sheet detector 33 (Step S14 in FIG. 8). Then, an additional feeding amount necessary for the recording region of the recording sheet P to reach the recording head 62 is found from the predetermined feeding amount.

When recording is performed so as to form a margin (YES in Step S31 in FIG. 14), a feeding amount C3 is calculated on the basis of the position of the sheet detector 33 (Step S32 in FIG. 14, FIG. 15A). By the feeding amount C3, the recording sheet P with a margin having a width Mc at the leading end is transported so that its recording region G reaches the recording head 62.

That is, since the distance F1 between the sheet detector 33 and the recording head 62 is fixed, the sum of the distance F1 and the margin width Mc serves as the feeding amount C3 by which the recording sheet P should be transported relative to the sheet detector 33. The difference between the feeding amount C and the predetermined feeding amount serves as a feeding amount of the recording sheet P that allows the recording region G to reach the recording head 62.

In contrast, when recording is performed so as not to form a margin (NO in Step S31 in FIG. 14), a feeding amount C4 is calculated on the basis of the position of the sheet sensor 34 (Step S33 in FIG. 14, FIG. 15B). The feeding amount C4 allows a recording region G1 larger than the recording sheet P to reach the recording head 62.

That is, since the distance F1 between the sheet detector 33 and the recording head 62 is fixed and the recording region G1 is larger than the recording sheet P by the width Md, a difference C4 between the distance F1 and the width Md serves as the feeding amount C4 by which the recording sheet P should be transported relative to the sheet detector 33. Therefore, a difference between the feeding amount C4 and the predetermined feeding amount serves as a feeding amount by which the recording sheet P is further transported so that the recording region G1 reaches the recording head 62.

Accordingly, even when the edge of the recording sheet P is not detected by the optical recording-sheet sensor 34, the sheet detector 33 can more reliably detect the recording sheet P by physical contact. Therefore, the feeding amount necessary for the recording region to reach the recording head 62 can be found on the basis of the position of the leading edge of the recording sheet P detected by the sheet detector 33. Further, recording can be performed on a predetermined position by transporting the recording sheet P by the feeding amount that is found in accordance with the presence or absence of a margin in an image to be recorded.

The above description of the ink jet recording apparatus is also applicable to recording apparatuses other than the ink jet recording apparatus, as long as recording is performed on a recording material that is transported in the sub-scanning direction. Further, the description is similarly applicable to a liquid ejecting apparatus that ejects liquid, such as a coloring agent, to a medium such as a color filter.

As described above, the ink jet recording apparatus according to the embodiment of the invention can minimize the change of the margin size even when the recording sheet is skewed.

Not only a moving head but also a fixing head (line head) is applicable as a head of the ink jet recording apparatus according to the embodiment of the invention.

The ink jet recording apparatus according to the embodiment of the invention can modify as follows. There might be a tendency to the skew direction depending on a design of a printer mechanism. In this case, the skew direction can be stored in a nonvolatile memory and the recording-material sensor to detect the leading edge can move to a predetermined direction based on the nonvolatile memory without judging whether the leading edge of a recording-material paper is right or left based on actual skew condition.

What is claimed is:

1. A recording apparatus, comprising:

a recording control unit configured to perform recording on a recording region of a recording material that is transported in a sub-scanning direction;

a carriage that reciprocates on the recording material in a main scanning direction orthogonal to the sub-scanning direction; and a first recording-material sensor provided in the carriage, the sensor configured to detect a leading edge of the recording material and further configured to detect right and left side edges of the recording material when the carriage moves on the recording material in a main-scanning direction;

wherein, when a margin is formed at least at a leading end of the recording material:

the recording control unit is configured to calculate a position of a center of the recording material based on positions of the right and left side edges of the recording material;

the recording material is transported upstream in the sub-scanning direction so that the recording edge thereof temporarily comes out of detection range of the first recording-material sensor;

the first recording-material sensor is configured to detect a center leading edge of the recording material at the position of the center of the recording material after the recording material is transported downstream in the sub-scanning direction; and the recording control unit is configured to perform recording on the recording region with reference to the center leading edge of the recording material; and wherein, when a margin is not formed at least at the leading end of the recording material:

the recording control unit is configured to determine a preceding leading edge from the right and left leading edges on the basis of a detection result of the first recording-material sensor when the first recording-material sensor is moved with the carriage on the recording material in the main-scanning direction from one side of the recording material to an other side of the recording material; and the recording control unit is configured to perform recording on the recording region with reference to the preceding leading edge of the recording material determined by the recording control unit.

2. The recording apparatus according to claim 1, further comprising:

a contact-type second recording-material sensor provided upstream from the first recording-material sensor in the sub-scanning direction so as to detect the leading edge of the recording material;

wherein the first recording-material sensor is an optical sensor;

wherein a position of the leading edge of the recording material detected by the second recording-material sensor serves as a reference position when the right and left side edges of the recording-material are not detected by the first recording-material sensor;

wherein recording is performed after the recording material is transported form the reference position by a first feeding amount when the margin is formed at least at the leading end of the recording material; and wherein recording is performed after the recording material is transported from the reference position by a second feeding amount that is smaller than the first feeding amount in accordance with the margin when the margin is not formed at least at the leading edge of the recording material.

3. The recording apparatus according to claim 1, wherein the recording control unit is configured to determine which of the first leading edge and the second leading edge is the preceding leading edge, the first leading edge corresponding to a first side of the recording material and the second leading edge corresponding to a second side of the recording material;

wherein if the first recording-material sensor always detects that the recording material exists when the first recording-material sensor is moved with the carriage from the first side to the second side, the recording control unit determines that the first leading edge is the preceding edge; and wherein if the first recording-material sensor does not always detect that the recording material exists when the first recording-material sensor is moved with the carriage from the first side to the second side, the recording control unit determines that the second leading edge is the preceding edge.

4. A recording method for detecting a leading edge of a recording material to be transported in a sub-scanning direction and performing recording on a recording region of the recording material with reference to the leading edge;

wherein recording is performed on the recording region with reference to a center leading edge of the recording material when a margin is formed at least at a leading end of the recording material; and wherein recording is performed with reference to one of right and left leading edges of the recording material when a margin is not formed at least at the leading end of the recording material, the one of right and left leading edges preceding in the sub-scanning direction.

* * * * *